United States Patent [19]

Baldwin

[11] Patent Number: 4,487,407

[45] Date of Patent: Dec. 11, 1984

[54] TRAIL EDGE COPY REGISTRATION SYSTEM

[75] Inventor: LeRoy A. Baldwin, Rochester, N.Y.

[73] Assignee: Xerox Corporation, Stamford, Conn.

[21] Appl. No.: 81,413

[22] Filed: Oct. 3, 1979

[51] Int. Cl.[3] ..... B65H 5/16; B65H 9/10

[52] U.S. Cl. ..... 271/233; 271/271; 271/252; 271/275; 355/3 SH; 355/14 SH

[58] Field of Search ..... 271/233, 271, 250, 252, 271/251, 236, 234, 237, 238, 243, 248, 249, 275; 355/3 SH, 14 SH; 198/688

[56] References Cited

U.S. PATENT DOCUMENTS

| | | | |
|---|---|---|---|
| 1,421,569 | 7/1922 | Ritchie et al. | 271/271 |
| 1,736,484 | 11/1929 | Broadmeyer | 271/251 |
| 2,249,186 | 7/1941 | Spiess | 271/251 X |
| 2,362,205 | 11/1944 | Huck | 271/271 |
| 2,381,713 | 8/1945 | Babicz | 271/271 X |
| 2,669,454 | 2/1954 | Babicz | 271/251 |
| 2,880,999 | 4/1959 | Oldenboom | 271/233 |
| 3,062,538 | 11/1962 | Rutkus et al. | 271/204 |
| 3,140,868 | 7/1964 | Hasselquist | 271/251 |
| 3,256,009 | 6/1966 | Reilly | 271/246 |
| 3,781,004 | 12/1973 | Buddendeck et al. | 271/243 X |
| 3,897,053 | 7/1975 | Guy | 271/271 X |
| 3,908,986 | 9/1975 | Bleau | 271/251 X |
| 3,915,447 | 10/1975 | Perno | 271/243 X |
| 3,970,299 | 7/1976 | Berger et al. | 271/233 X |

OTHER PUBLICATIONS

Looney, J., "Copy Sheet Registration System", *Xerox Disclosure Journal*, vol 1, No. 5, May 1976, p. 85.

*Primary Examiner*—Bruce H. Stoner, Jr.
*Assistant Examiner*—James E. Barlow
*Attorney, Agent, or Firm*—William A. Henry, II

[57] ABSTRACT

A trail edge registration system is disclosed that includes drive belts adapted to accept sheets from a source. The drive belts have pin-like members on the surface thereof that are adapted to contact the trail edge of the sheets and provide the timing and skew registration function, as well as the transport function for the system. A scuffer roll mechanism side registers the sheets in the transport before they are contacted by the pin-like members on the belts.

2 Claims, 2 Drawing Figures

A
B
C
D
E
F
10
12
14
16
18
20
22
24
28
30
32
34
36
38
42
46
50
52
54
56
58
60
62
64
69
70
71

TRAIL EDGE COPY REGISTRATION SYSTEM

BACKGROUND OF THE INVENTION

This invention relates to an electrophotographic printing machine, and more particularly concerns a trail edge copy registration system in a printing machine.

A typical electrophotographic printing machine utilized in the business office environment contains stacks of cut sheets of paper on which copies of original documents are reproduced. Generally, these cut sheets of paper are advanced through the printing machine, one sheet at a time, for suitable processing therein. Frequently, papers are advanced through the printing machine by transport subsystems. These subsystems are those sections of the paper handling module which drive copy paper from one printing processing station to another. Copy paper is directed to and from various subsystems by baffles and/or selection gates. All transports are directly driven from the main power drive and become operational upon "print command." The gates are usually solenoid operated and direct the copy paper as required to meet user selected output requirements. Attempts are made to design each transport where possible to allow ready accessibility to the copy paper by untrained machine operators. Coin switches are located throughout the various transports to provide jam protection.

One of the existing and standard methods for deskewing and side registering substrates in a copier includes the use of a ball-on-belt system. This system is used with a lead edge timing scheme and allows the lead edge of a substrate, driven by the belt, to be timed into a set of take away rolls so that the substrate reaches the transfer station in synchronism with a particular image on the photoreceptor. Some of the problems associated with this type of lead edge and side registration system encompasses mechanical drives for deskewing and shift registration and take away pinch roll drives.

PRIOR ART STATEMENT

Various other methods have been used to transport and register substrates with the following prior art appearing relevant:

| Applicant(s) | U.S. Pat. No. | Issue Date |
|---|---|---|
| G. Spiess | 2,249,186 | 7/15/41 |
| J. Rutkus, Jr. et al. | 3,062,538 | 8/1/60 |
| R. Reilly | 3,256,009 | 12/23/63 |
| G. Buddendeck | 3,781,004 | 12/25/73 |
| C. Bleau | 3,908,986 | 9/30/75 |
| B. Perno | 3,915,447 | 10/28/75 |

Xerox Disclosure Journal, Vol. 1, No. 5, May 1976, page 85.

The pertinent portions of the foregoing prior art may be summarized as follows:

Spiess discloses a system for transverse feeding sheets or the like by the use of a transverse conveying table and press bodies, i.e., balls, brushes or rollers, or the like.

Rutkus et al. shows grippers that hold sheets on a chain conveyor for movement through copier processing stations.

Reilly discloses a sheet registration device that arrests and aligns each individual sheet during travel and then in timed relation to the movement of the photoreceptor advances the sheet into engagement with the photoreceptor in registration with a previously formed xerographic image on the photoreceptor.

Buddendeck shows two conveyor systems from supply to output with each traveling at a different speed and a switching device arranged between the conveying devices operatively connected to a time sequence programing system which controls the feeding of sheets from a supply to the first conveying system.

Bleau discloses a sheet aligning mechanism which urges sheets by the use of a feed roll and a cooperating pinch member into both a leading edge aligner and a side edge aligner.

Perno shows a sheet handling apparatus that includes a moveable belt which has multiple tabs extending therefrom. The tabs are adapted for deskewing and registering the lead edge of a sheet presented thereto, the tabs thereafter being forced into contact with the lead edge of the sheet to grip the sheet for subsequent conveyance.

Looney discloses in his Xerox Disclosure Journal publication a sheet registration system for providing front edge registration in space and time for a sheet while the sheet is moving.

SUMMARY OF THE INVENTION

In accordance with the present invention, there is provided a trail edge and side edge copy sheet registration system. It includes an improvement over the above-mentioned ball-on-belt lead edge registration system and comprises a feed means for feeding a sheet toward the registration system and belt means for receiving the sheet from the feed means, the belt includes fingers extending vertically therefrom for capturing the trail edge of the sheet and thereby supplying the timing as well as providing deskewing for the system. Before the fingers capture the trail edge of the copy, scuffer roll side registration means registers the copy sheet against a side stop means.

BRIEF DESCRIPTION OF THE DRAWING

Other features of the present invention will become apparent as the following description proceeds and upon reference to the drawings in which.

DESCRIPTION OF THE PREFERRED EMBODIMENT

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
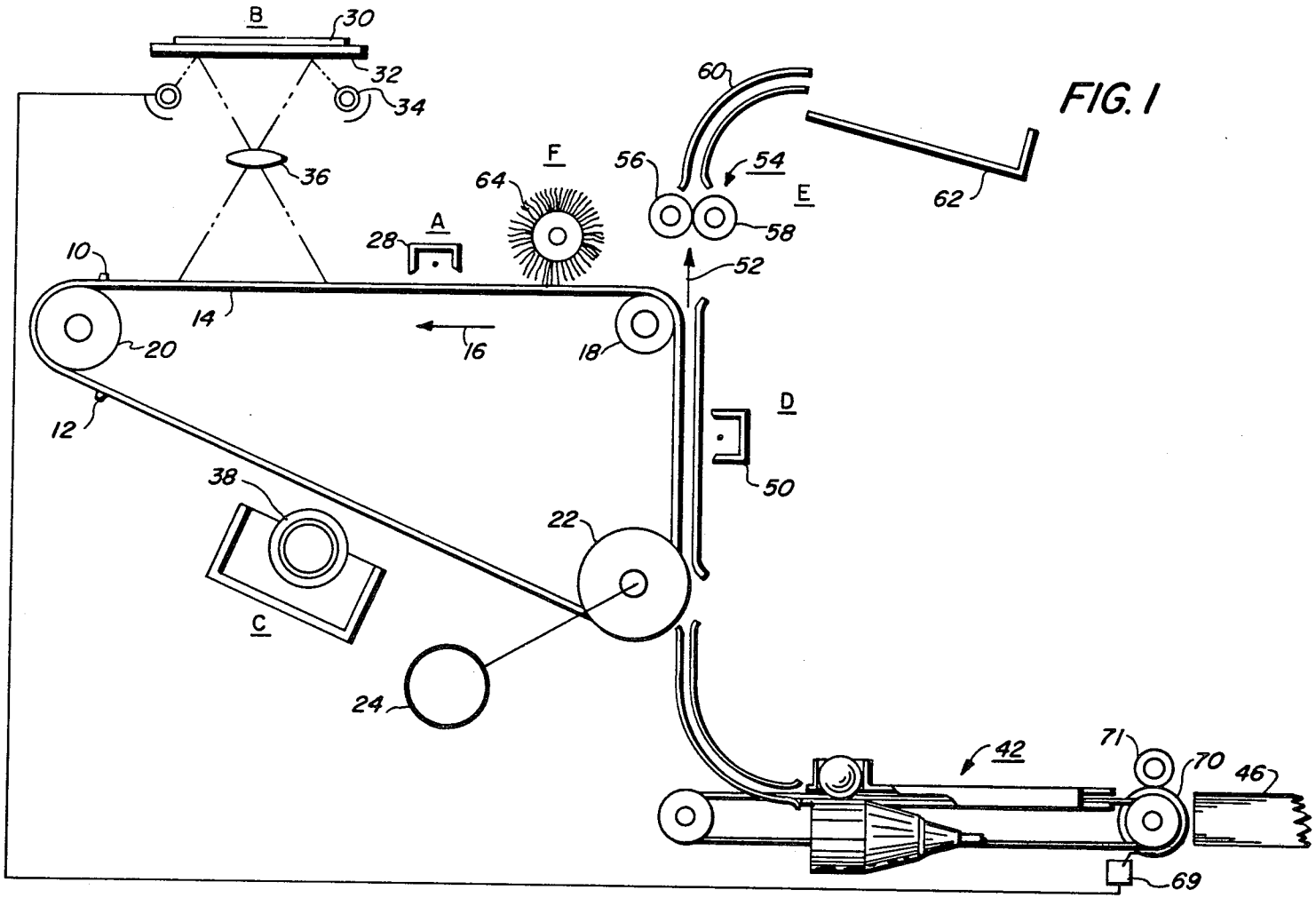
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incoporating the trail edge registration apparatus of the present invention therein. It will become evident from the following discussion that the trail edge registration system disclosed herein is equally well suited for use in a wide variety of devices and is not necessarily limited to its application to the particular embodiment shown herein. For example, the apparatus of the prsent invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides 26. Edge guides 26 are mounted on opposite ends of drive roller 22 defining its space therebetween which determines the desired predetermined path of movement for belt 10. Edge guide 26 extends in an upwardly direction from the surface of roller 22. Preferably, edge guides 26 are circular members or flanges.

Belt 10 is maintained in tension by a pair of springs (not shown), resiliently urging tension roller 22 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductor surface 12 of the belt 10 to a relatively high, substantially uniform potential. A suitable corona generating device is described in U.S. Pat. No. 2,836,725 issued to Vyverberg in 1958.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the informational areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner power image on photoconductive surface 12 of belt 10.

Belt 10 then advances the toner powder image to transfer station D. At transfer station D, a sheet of support material is moved into contact with the toner powder image. The sheet of support material is advanced toward transfer station D by trail edge registration device 42. Preferably, the registration device 42 includes pinch rolls 70 and 71 which rotate so as to advance the uppermost sheet feed from stack 46 into transport belts 48 and 49. The transport belts direct the advancing sheet of support material into contact with the photoconductive surface 12 of belt 10 in a timed sequence so that the toner powder image developed thereon synchronously contacts the advancing sheet of support material at transfer station D.

Transfer station D includes a corona generating device 50 which sprays ions into the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrostatographic printing machine.

Figure 2:
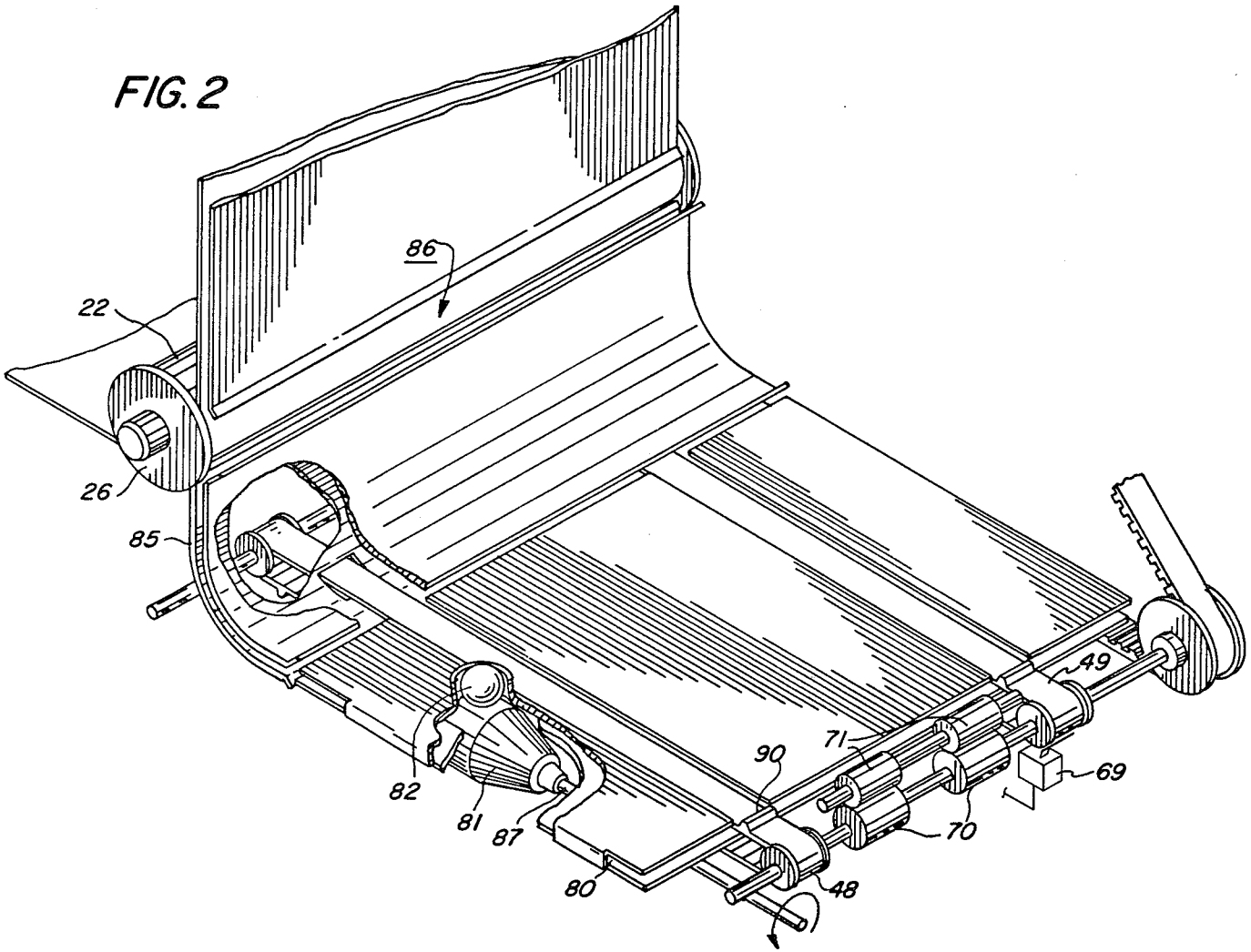
FIG. 2 is a partially exploded schematic of the apparatus of the present invention.

Referring now to the specific subject matter of the present invention, FIG. 2 shows a scuffer roll side registration and finger-on-belt trail edge timing concept. A substrate enters the registration subsystem positively driven by opposing pairs of pinch rolls 70 and 71. When the substrate trail edge passes through the nip formed between pinch rolls 70 and 71, it is driven toward, and side registered against, edge 80 by scuffer roll 81 and ball 82. At this time, fingers 90 attached or molded into belts 48 and 49 come around and contact the trail edge of the substrate or paper thereby both transporting the paper and supplying the timing function and deskewing function, i.e., synchronizing the substrate with a specific, repeatable location on the photoreceptor (onto which the image can be placed). While the fingers are shown here equidistant from each other o belts 48 and 49, it should be understood that one fnger on each belt will work as will three or more on each belt. A baffle 85 consisting of parallel surfaces approximately 3 mm apart guides the substrate into the xerographic transfer zone 86. The tacking forces of transfer slightly overdrive the substrate pulling it away and thus uncoupling it from the forward drive of fingers 90.

In addition to supplying the machine configurational flexibility of a trail edge option, trail edge registration combines the timing and transport function and thereby reduces cost. Other advantages of trail edge registration include precise directional control of the lead edge of the substrate at the entrance to transfer and the providing of a reliable means of uncoupling the timing drive from the photoreceptor/transfer drive.

The side registration technique employed in the registration system of the present invention comes into play as paper is positively driven from tray 46 by pinch rolls 70 and 71. The lead edge of the paper passes between scuffer member 81 which is rotating in the direction of arrow 87, and normal force ball 82 before the trail edge of the paper leaves the pinch rolls. When the trail edge of the paper exits the pinch rolls, it is driven sideways and registered against side registration edge or stop 80 where it stops and waits for finger 90 to come into contact with the paper trail edge and supply the forward transport force. By keeping the surface speed of the scuffer roll 81 large with respect to the paper speed, the friction force $\mu N$, (where $\mu$ is the coefficient of friction between the scuffer and paper, and N is the normal force (weight supplied by ball 82) acts in the direction of the scuffer motion, i.e., toward the side registration edge 80, and does not restrict the paper from moving along the main axis of the paper path. If the axis of the scuffer shaft is set at a small angle to the paper path, a slight forward driving force is generated which will "null out" the majority of the paper path and side registration drag forces. Thus, the scuffer roll supplies a continuous low level force sufficient to side register a wide range of copy paper weights which does not impede the forward motion of the paper.

Preferable parameters for optimum operation of the side registration technique of the present invention comprises a scuffer surface speed four to five times the paper speed; a normal force of ball 82 of $N = \approx 0.10$ to 0.15 lbs.; a coefficient of friction where $\mu = \approx 0.2$ to 0.4; and an angle of the scuffer shaft to the paper path of from about 0° to about 15°.

In this exemplary apparatus, the image on the photoreceptor is synchronized with the location of the copy paper by adjusting flash time. This is done by fingers 90 tripping a switch 69 which initiates a flash or exposure sequence. This sequence includes a reverse countdown until flash. Synchronization is achieved by adjusting the time.

In conclusion, a trail edge and side registration system is disclosed that comprises pins secured to drive belts that accept paper from a paper tray. As the paper leaves a nip located downstream of the paper tray, a side scuffer with normal force ball engages the paper and side registers it against a side guide. Subsequently, the pin members located on the belts contact the trail edge of the paper and propels it in synchronism with an image on the photoreceptor toward the transfer zone. Tacking forces in the transfer zone override the paper directional force of fingers 90 and guides the paper through the transfer zone toward fusing station E.

In addition to the method and apparatus disclosed above, other modifications and/or additions will readily appear to those skilled in the art upon reading this disclosure and are intended to be encompassed within the invention disclosed and claimed herein.

What is claimed is:

1. In a copier system having an image processor which forms images on a copy substrate, means for exposing images of documents to said processor, transfer means for transferring the images of the documents from said processor to the copy substrate, and feed means for feeding the copy substrate to said processor, the improvement comprising:

copy substrate trail edge registration means for transporting and registering the copy substrate in synchronism with an image produced by said processor, said copy substrate registration means including belt means for receiving the copy substrate from said feed means, said belt means comprises an enclosed loop of material with integral discrete fingers molded therein and spaced along the loop, said fingers extending vertically therefrom for capturing the trail edge of the copy substrate and registering the copy substrate while transporting it toward said processor, said transfer means comprises a corona generator which sprays ions onto the backside of copy substrate as they pass the generator, said ions electrostatically attaching the copy substrates to said processor causing said processor to pull the copy substrates away from said copy substrate registration means and transport the copy substrates for further processing.

2. In a copier system having an image processor which forms images on a copy sheet, means for exposing images of documents to said processor, transfer means for transferring the images of the documents from said processor to the copy sheet, and feed means for feeding the copy sheet to said processor, the improvement comprising:

control means for registering the copy sheet by its trail edge in synchronism with an image produced by said processor and for triggering said exposure means to supply said image to said processor, said control means includes belt means for receiving the copy sheet from said feed means, said belt means comprising an enclosed loop of rubberized material with integral discrete fingers molded therein and spaced along the loop, said fingers extending vertically therefrom for capturing the trail edge of the copy sheet while transporting the copy sheet toward the processor, and switch means which is actuated by said fingers on said belt to expose said image to said processor in synchronism with the position of the copy sheet on said belt.

* * * * *